United States Patent [19]

Thornton

[11] Patent Number: 4,827,631

[45] Date of Patent: May 9, 1989

[54] WALKING SHOE

[76] Inventor: Anthony Thornton, 1601 Fourth St. South, Minneapolis, Minn. 55454

[21] Appl. No.: 208,587

[22] Filed: Jun. 20, 1988

[51] Int. Cl.[4] ..... A43B 1/10

[52] U.S. Cl. ..... 36/102; 36/103; D2/320

[58] Field of Search ..... 36/30 R, 31, 102, 103, 36/114, 116, 123, 124, 129; D2/317, 320

[56] References Cited

U.S. PATENT DOCUMENTS

| | | | |
|---|---|---|---|
| D. 85,333 | 7/1931 | Heilhecker . | |
| D. 247,267 | 2/1988 | Dolinsky . | |
| D. 266,287 | 9/1982 | Blissett et al. . | |
| 2,100,492 | 10/1933 | Sindler . | |
| 2,930,149 | 3/1960 | Hack et al. . | |
| 3,402,485 | 9/1968 | McMorrow . | |
| 3,414,988 | 12/1968 | Mattos . | |
| 4,322,891 | 4/1982 | Inohara . | |
| 4,364,190 | 12/1982 | Yonkers . | |
| 4,378,641 | 4/1983 | Tarlow | 36/114 |
| 4,439,936 | 4/1984 | Clarke et al. . | |
| 4,589,216 | 5/1986 | Fuscone . | |
| 4,610,099 | 9/1986 | Signori . | |
| 4,694,591 | 9/1987 | Banich et al. . | |
| 4,704,808 | 11/1987 | Bianchini | 36/102 |
| 4,777,738 | 10/1988 | Giese | D2/320 |

OTHER PUBLICATIONS p. 28, of FN Magazine (Mar. 1984).

*Primary Examiner*—Werner H. Schroeder
*Assistant Examiner*—Diana L. Biefeld
*Attorney, Agent, or Firm*—Burd, Bartz & Gutenkauf

[57] ABSTRACT

A walking shoe having a sole provided with a toe section and a heel equipped with an outwardly directed U-shaped flange. The toe section has a longitudinal center pad located between transverse pads. Ground engaging cleats are located on the bottom of the flange and heel section located between the flange. A counter having a reinforcing cup provided with an outwardly directed lip is secured to the flange to laterally stabilize the heel of the shoe and ensure control of the foot during walking.

29 Claims, 4 Drawing Sheets

WALKING SHOE

FIELD OF THE INVENTION

The invention pertains to the field of orthopedic products and more particularly to walking shoes for use by persons to absorb and distribute impact force on the foot in a controlled manner during walking.

BACKGROUND OF THE INVENTION

The function of the foot during walking is that of balance and support with forward locomotion maintained by the lower extremities and momentum of the upper body. The foot acts as a mobile adaptor to the ground at heel stroke and early stance phase and then stabilizes to function in propulsion of push-off. Body weight is accepted into the foot at heel strike and transferred anteriorly during foot flat and push-off. The heel first contacts the ground in an inverted position. The adaptation of the foot to the ground occurs by eversion of the calcaneus and pronation of the subtalar and midtarsal joints. The medial longitudinal arch undergoes structural change during early stance phase by accepting weight from the talas as it assumes a plantarflexed and adducted position. At midstance, external rotation of the lower extremity initiates supination of the foot. The calcaneus inverts and the talas moves into abduction and dorsiflexion, thereby locking the midtarsal joint, allowing the foot to become more rigid during push-off. Supination is further assisted by the oblique axis between the second and fifth metatarsals which causes the midfoot to supinate passively as weight is shifted onto the metatarsals. The foot also becomes more stable at push-off due to the windlass mechanism of the plantar fascia and the activity of the gastrocsoleus muscle group. During walking, the ground reaction forces in each foot segment varies during different phases of the gait cycle. Weight distribution moves through a line of central pressure. Generally, the center of pressure begins at the lateral heel, moves forward into the midfoot, and then shifts medially where it exits between the first and second toes at push-off. At push-off all of the ground reaction forces are concentrated on the metatarsus and toes. Substantial forces are transferred to the heel, ball and toe of each foot during walking, jogging and running activities. These biomechanics of the foot are reviewed by Gordon E. Doxey in the *Journal of Orthopedic and Sports Therapy* May/June 1985 Pages 324–333.

SUMMARY OF INVENTION

An invention is directed to a walking shoe having motion control, comfort, durability, flexibility and strength. Shoe is relatively light weight and provides the foot with stability to enhance natural walking action. The shoe has a heel with an outwardly directed general U-shaped flange that cooperates with a reinforcing heel counter to stabilize the heel of a foot and provides for motion control of the foot during walking. The forward portion of the sole has a longitudinal pad located between a plurality of lateral pads that provide for lateral stability of the ball portion of the foot and yet permit transverse flexibility allowing for natural push-off during walking. The shoe has a sole generally shaped like the bottom of a human foot divided into a heel, toe section and an arch joined to the heel and toe section. The heel has an outwardly directed inside and outside flange means extended along the opposite sides and around the back thereof. A plurality of generally first longitudinal cleats or pads project downwardly from the inside and outside flange means to provide the heel with motion control and lateral and longitudinal stability. First transverse pads are located between the first longitudinal pads. These pads are longitudinally spaced from each other to provide the heel with transverse flexibility as well as distribute the impact force over the large area of the bottom of the heel. The toe section of the sole has a second longitudinal pad extended downwardly along the center line of the sole forwardly of the arch. A plurality of downwardly directed longitudinally spaced second transverse pads are located adjacent opposite sides of the second longitudinal pad. These pads laterally stabilize the toe portion of the foot and allow for transverse flexibility of the sole. Additional transverse pads are located forwardly of the second longitudinal pad. Further transverse pads are located rearwardly of the second longitudinal pad. The arch has a generally square pad. The transverse pads of the toe section of the sole are surrounded with a downwardly directed peripheral rib.

The counter of the shoe has an upright generally U-shape or cup-shape reinforcing means that is mounted on the heel of the shoe. The reinforcing means has a U-shaped body adapted to receive the heel of a foot and extend around the back and adjacent the opposite sides of a person's heel. The reinforcing means has outwardly directed lips that are secured to the flange means. The inside of the shoe has an insole that is located over the sole. A shock absorbing cushion of resiliant material is located over the insole. A cover means surrounds the reinforcing means of the counter and extends over the toe section to provide a body for a person's foot. The side wall of the toe section of the shoe and a connecting strip has a V-shaped notches that allow for transvere flexibility of the toe section of the shoe. The counter in cooperation with outwardly directed flanges on opposite sides of the heel provide the shoe with lateral stability and motion control without sacrificing comfort, durability, or flexibility of the heel of the sole. This reduces the pronation effects on the foot joints, knee joints as well as the hip joints of a person.

DESCRIPTION OF PREFERRED EMBODIMENT

Figure 1:
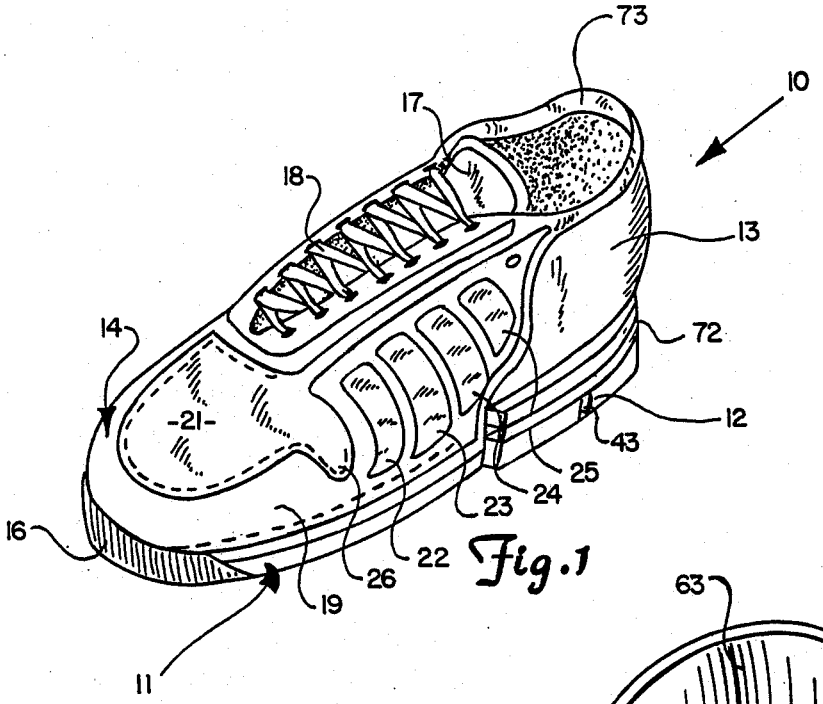
FIG. 1 is a perspective view of a walking shoe of the invention.

Referring to FIG. 1 there is shown a left walking shoe indicated generally at 10 of the invention. The right shoe (not shown) has the same structure and advantages as shoe 10. The following description is limited to the left walking shoe 10 with the understanding that the right walking shoe has the same structure and features and is adapted to accommodate the right foot of a person.

Shoe 10 has a sole 11 having a heel 12. A counter 13 is mounted on top of heel 12 and is joined to forwardly directed upper body 14 terminating in a front portion or toe 16. Body 14 has a longitudinal top opening that is located adjacent an elongated tongue 17 and closed with a lace or string 18. Upper body 14 has a side wall 19 joined to the outer peripheral upper edge of sole 11. A fabric 21 is secured to the top of side wall 19 to complete upper body 14. Side wall 19 has upright side openings 22, 23, 24 and 25 that are longitudinally spaced from each other to provide the sides of the upper body with limited longitudinal and lateral stretch. The openings are covered with a fabric. The mid-portion of side wall 19 has a downwardly directed V-notch 26 that is generally located adjacent the area that accommodates the little toe of a person's foot. Notch 26 allows the side wall 19 to transversely bend with sole 11 during walking.

Figure 2:
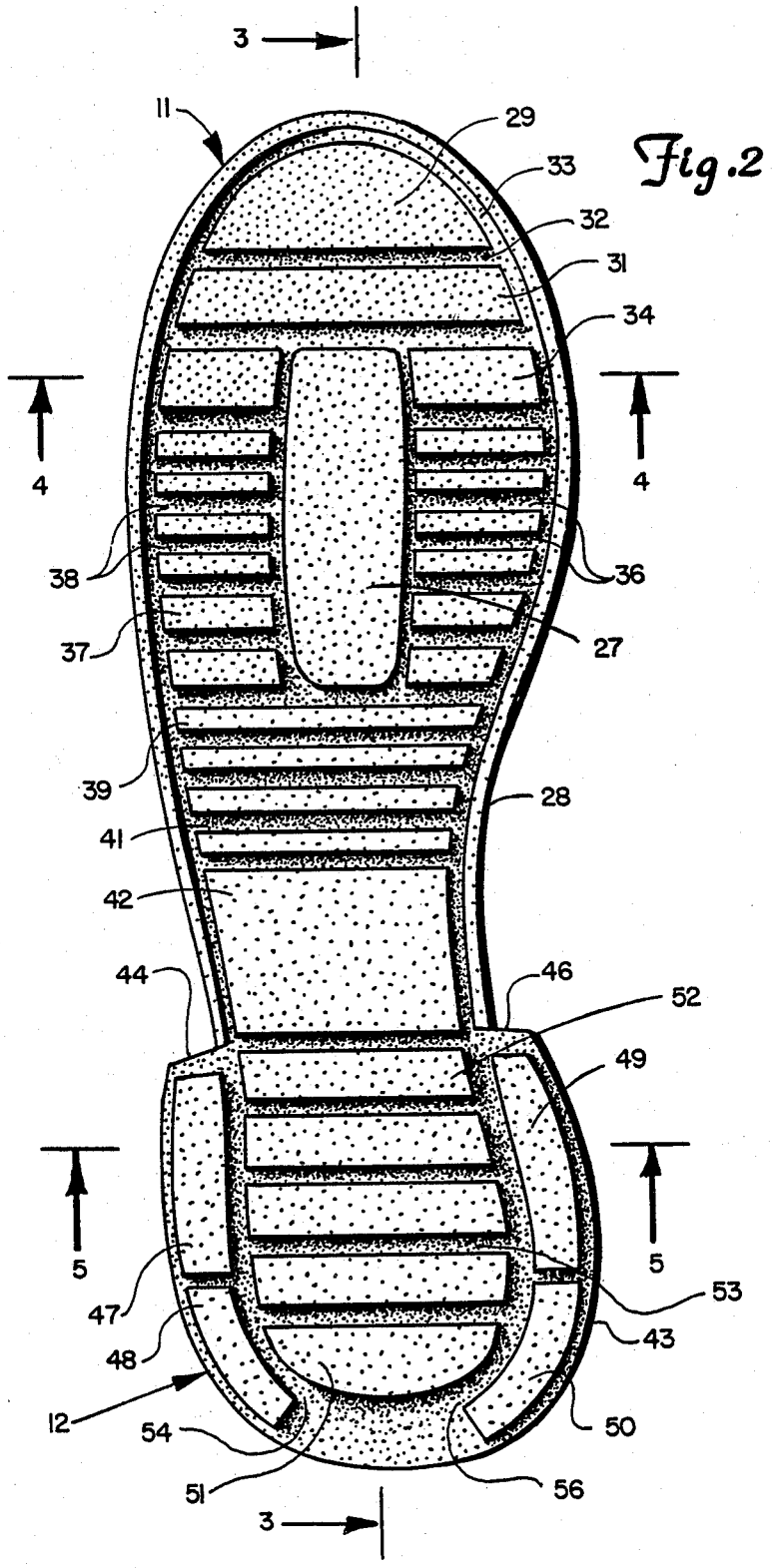
FIG. 2 is an enlarged plan view of the bottom of the sole of the shoe of FIG. 1.
Figure 4:
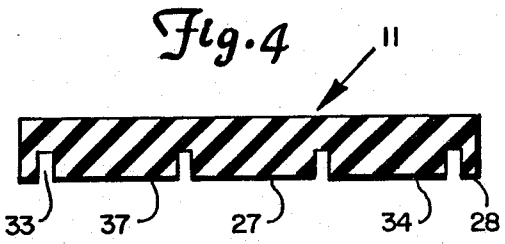
FIG. 4 is a sectional view taken along the line 4—4 of FIG. 2.
Figure 5:
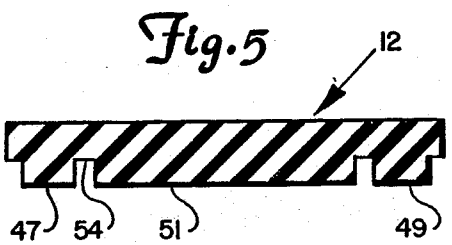
FIG. 5 is a sectional view taken along the line 5—5 of FIG. 2.
Figure 3:
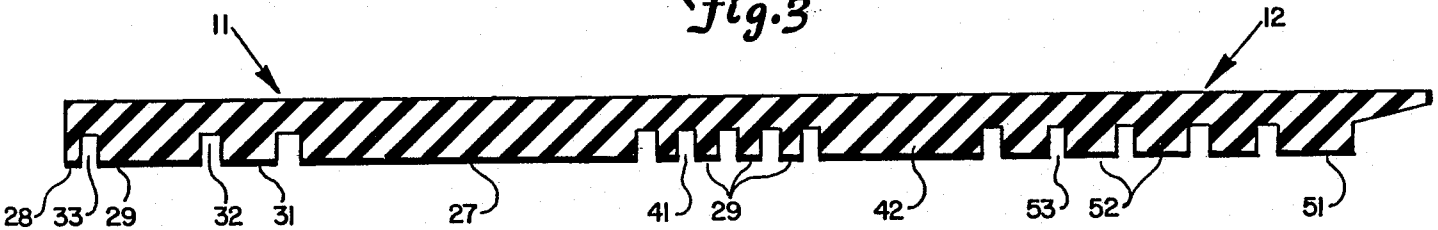
FIG. 3 is a sectional view taken along the line 3—3 of FIG. 2.

Referring to FIG. 2, the bottom of sole 11 has a longitudinal central pad 27 located along the longitudinal center line of the sole. The pad 27 has a generally rectangular configuration and extends from the mid-portion of the ball of the foot toward the arch. The outer peripheral edge of sole 11 has a continuous rib 28 that is spaced from a semi-circular toe pad 29 and adjacent rectangular transverse pad 31. A transverse groove 32 separates pads 29 and 31. Opposite ends of groove 32 are open to a peripheral channel 33 that is located adjacent the inside of rib 28.

A plurality of the side pads 34 are located adjacent the inside of central pad 27. Lateral grooves 36 separate the adjacent side pads 34 from each other. A plurality of longitudinally spaced side pads 37 are located adjacent the outside of center pad 27. Lateral grooves 38 separate adjacent pads 37 from each other. The lateral grooves 38 are in transverse alignment with lateral grooves 36. The side pads 34 and 37 have generally the same rectangular configuration.

A plurality of transverse ribs 39 are located between the center pad 27 and the arch. Transverse grooves 41 separate adjacent ribs from each other. Grooves 41 are open to the peripheral channel 33. A generally square arch pad 42 is located adjacent rib 39 and the heel portion of the sole.

Heel 12 of sole 11 has an outwardly directed generally U-shaped flange 43 having forward opposite edges or shoulders 44 and 46. The outside section of flange 43 has outside cleats or pads 47 and 48. The inside portion of flange 43 has inside cleats or pads 49 and 50. Pads 47 and 48 are generally elongated rectangular structures that are spaced a short distance inwardly from the outer peripheral edge of U-shape flange 43. Pads 48 and 50 are arcuate and curved toward the rear of heel 12. Located between pads 48 and 50 is a generally semi-circular heel pad 51. A plurality of transverse pads 52 extends between pad 51 and the arch pad 42. Transverse grooves 53 separate pads 52 from each other. As shown in FIG. 2, there are four generally rectangular transverse pads 52 located between semi-circular heel pad 51 and the generally square arch pad 42. The outer edges of pads 51 and 52 are separated from the pads 47 and 48 with a generally longitudinal groove 54. The opposite ends of pads 51 and 52 are separated from the side pads 49 and 50 with a generally longitudinal groove of 46. The rear portions of grooves 54 and 46 curve inwardly toward each other adjacent the back of the heel pad 51.

When heel 12 engages the ground or support surface the impact force on the heel is directed to the ground through pads 47, 48 and 49, 50 on opposite sides of the heel of the foot and directly below the heel through transverse pads 51 and 52.

The initial impact force begins at pad 48 and the rear of flange 43. The force causes limited flexing of the rear of flange 43 which absorbs and distributes part of the impact force. As the foot moves forward the impact force spreads across the heel of the foot and then shifts to the front of the foot. Some of the impact forces are spread to opposite sides of the heel providing the foot with lateral stability and motion control.

Figure 6:
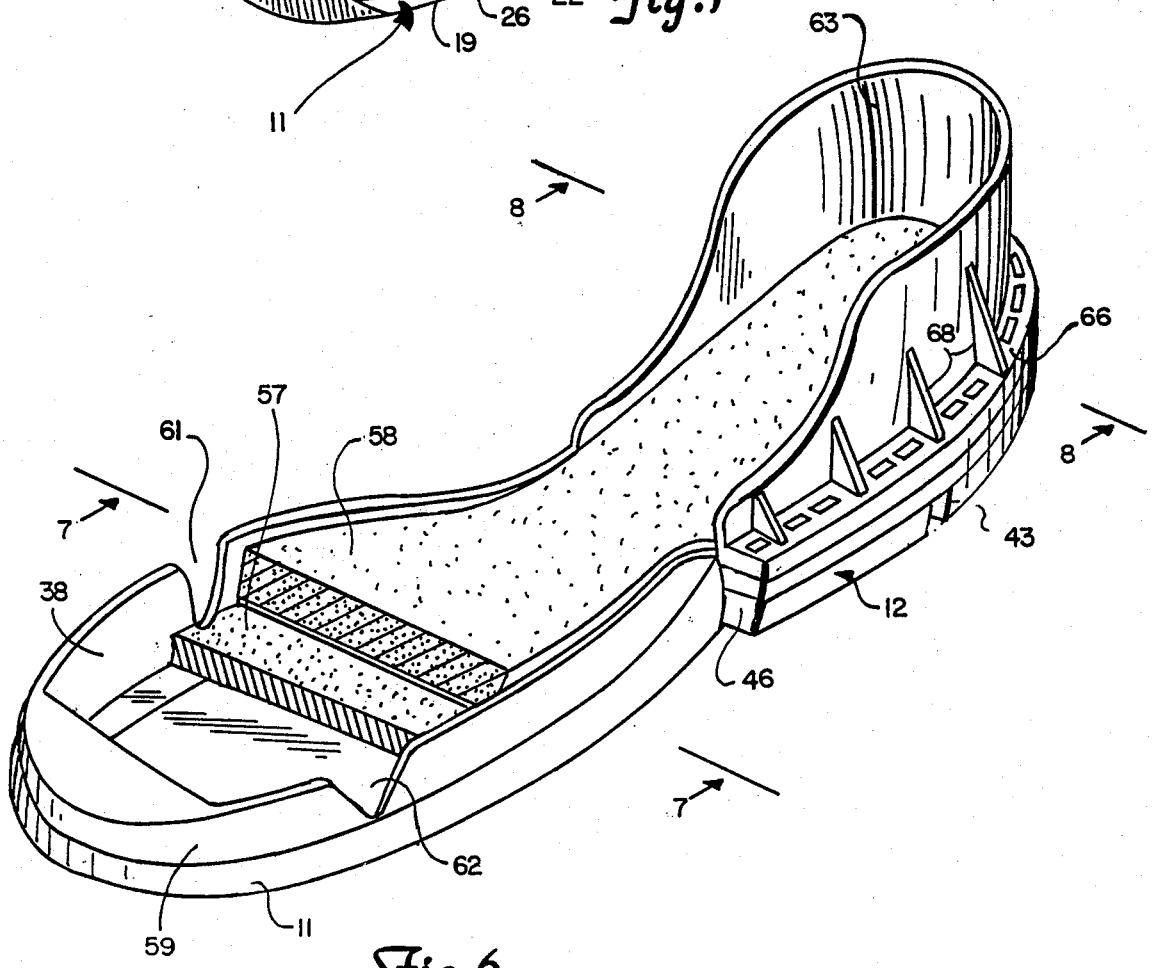
FIG. 6 is a perspective view of the sole, counter reinforcing structure, and inner sole of the shoe.
Figure 8:
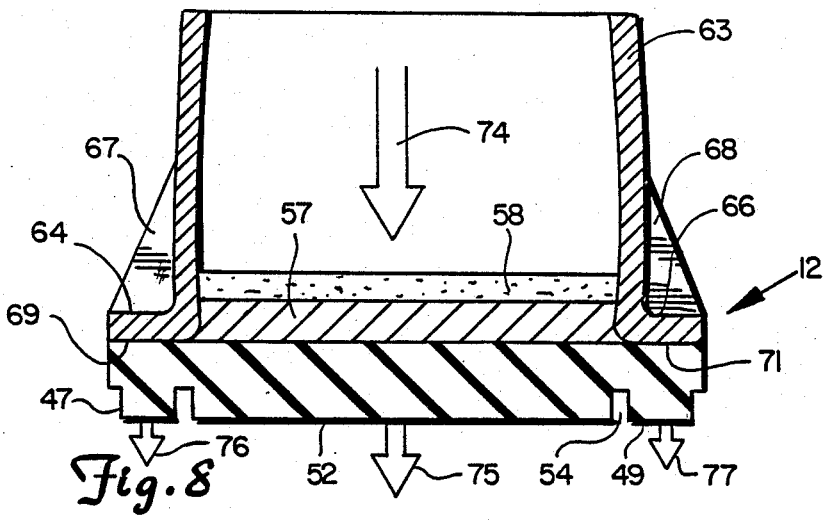
FIG. 8 is a sectional view taken along the line 8—8 of FIG. 6.
Figure 7:
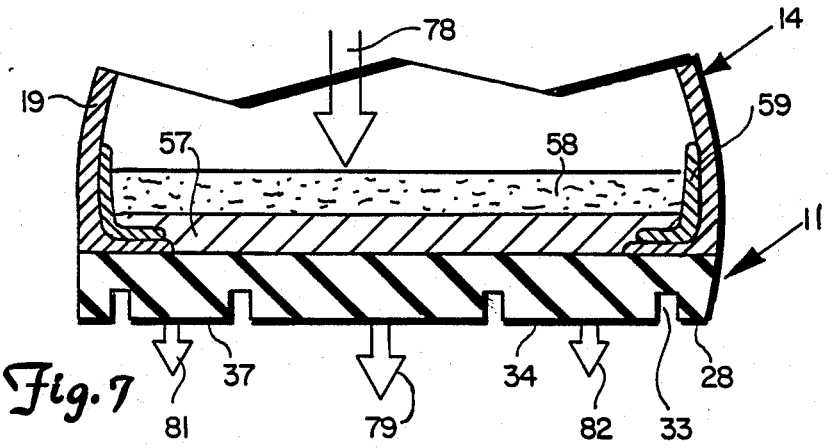
FIG. 7 is a sectional view taken along the line 7—7 of FIG. 6.

Referring to FIGS. 6, 7 and 8 shoe 10 has an inner sole 57 located over the top of sole 11. A foot pad or cushion 58 covers the top of inner sole 57. Cushion 58 has the shape on the bottom of a human foot and functions to absorb and distribute impact force on the foot during walking activities. Cushion 58 may be permanently attached to inner sole 57. Alternatively, cushion 58 can be a removeable and replaceable unit. The outer peripheral edge of the inner sole 57 is located on an angular elongated side strip 58 and 59 secured to sole 11 and side wall 19 by adhesive, bonding materials, stitches or the like. Strip 59 as well as the lower edges of side wall 19 and the bottom of inner sole 57 are secured to the top of sole 11. As shown in FIG. 6, strip 59 has side V-notches 61 and 62 to facilitate the transverse bending of sole 11 and inner sole 57 across body 14 of the shoe. This facilitates the longitudinal bending of the shoe during push-off.

Referring to FIG. 6, a generally cup-shaped counter body 63 surrounds the heel of the shoe. Counter body has a generally upright rigid side wall joined to outwardly directed lips or flanges 64 and 66. Flanges 64 and 66 are a continuous outwardly directed member located on top of sole flange 43. The outwardly directed member has a general horizontal U-shape. A plurality of gusset 67 and 68 are joined to lip 64 and 66 and adjacent portions of the side wall of counter body 63 to reinforce the counter body and thereby providing for lateral stability of the foot during walking. Lips 64 and 66 are secured to the outer peripheral portions of sole 11 with adhesives 69 and 71 or suitable bonding material. Stitches may be used to secure lip 64 and 66 to sole 11. As shown in FIG. 1 lips 64 and 66 and gusset 67 and 68 are covered with a covering strip 72 and an outer skin or cover 73. The upper edge of cover 73 extends over the top of the counter body 63 forming a smooth generally curved top edge of the shoe.

During walking the heel force indicated by arrow 74 in FIG. 8 initially is transmitted through the heel of sole 11 via the pads 51 and 52 as indicated by the arrow 75 and a rear of sole 11. Forces indicated by arrow 76 and 77 are also distributed via the side pads 47, 48 and 49, 50 to the support surface. These forces are laterally of the inside and outside of the heel of the foot thereby stabilizing the heel, muscle, and joints thereof in a generally natural upright direction. The weight distribution during a walk moves through a line of central pressure and rolls up onto the longitudinal central pad 27. As indicated by arrow 79 in FIG. 7. The weight is also directed through the side pads 34 and 37 as indicated by arrows 81 and 82. At push-off substantial forces are directed via the metatarsals and toes through toe pad 29.

While there has been shown and described an embodiment of the walking shoe of the invention it is understood that changes in the materials, structure, arrangement of structure may be made by those skilled in the art without departing from the invention. The invention is defined in the following claims.

I claim:

1. A shoe for a human foot comprising:

a sole having the general shape of a bottom of a human foot including a heel, a toe section and an arch section located between the heel and toe section, said heel having outwardly directed inside and outside flange means adjacent opposite sides thereof, a plurality of generally first longitudinal pads projected downwardly from said inside and outside flange means, a plurality of downwardly directed longitudinally spaced first transverse pad means located between said first longitudinal pads, said toe section having a second longitudinal pad extended along the center line of the sole and projected in a downward direction, a plurality of downwardly directed longitudinally spaced second transverse pad means located adjacent opposite sides of said second longitudinal pad, downwardly directed third transverse pad means located forwardly of the second longitudinal pad and second pad means, downwardly directed fourth transverse pad means located between the second longitudinal pad and the first pad means, a counter having an upright generally U-shaped reinforcing means mounted on the heel section, said reinforcing means having a U-shaped body adapted to extend around the back of a person's heel, and outwardly directed lip means secured to said flange means, an insole located over the sole, and cover means surrounding said reinforcing means and providing a body for the foot.

2. The shoe of claim 1 wherein: said first longitudinal pads include a pair of pads on each of said inside and outside flange means.

3. The shoe of claim 2 wherein: said first transverse pads means each have a generally rectangular shape.

4. The shoe of claim 1 including: a semi-circular shaped transverse pad located between the first longitudinal pads.

5. The shoe of claim 1 wherein: the second longitudinal pad has a generally rectangular shape.

6. The shoe of claim 5 wherein: the second transverse pad means each have a generally rectangular shape.

7. The shoe of claim 1 wherein: the third transverse pad means includes a transverse pad means, a transverse generally rectangular pad and a semi-circular shaped pad located forwardly of the rectangular pad.

8. The shoe of claim 1 wherein: the fourth transverse pad means each have a generally rectangular shape.

9. The shoe of claim 1 including: a downwardly directed pad joined to the arch section of the sole.

10. The sole of claim 1 including: rib means joined to the lip means and body to reinforce the upright position of the body.

11. The shoe of claim 1 including: a downwardly directed rib extended around the outer peripheral edge of the toe and arch section of the sole.

12. The shoe of claim 11 including: a downwardly open groove adjacent the inside of said rib separating the rib from second, third, and fourth transverse rib means.

13. A shoe to accommodate a human foot comprising sole means having the general shape of the bottom of a human foot including a heel, toe section, and an arch section located between the heel and toe section, said heel having an outwardly directed inside and outside flange means adjacent opposite sides thereof. longitudinal pad means projected downwardly from said inside and outside flange means and pad means on said toe section extended downwardly therefrom.

14. The shoe of claim 13 including: transverse pad means located between said longitudinal pad means on said heel extended downwardly therefrom.

15. The shoe of claim 13 wherein: said pad means on toe section include a second longitudinal pad extended along the center line of the sole and projected in a downward direction and second transverse pad means located adjacent opposite side of the second pad extended in a downward direction adapted to engage a support.

16. The shoe of claim 15 including: third transverse pad means located forwardly of the longitudinal pad and fourth transverse pad means located between the longitudinal pad and the heel section.

17. The shoe of claim 13 including: a counter having a generally upright U-shaped reinforcing means mounted on the heel sections, said reinforcing means having a U-shape body adapted to extend around the back and adjacent the sides of a person's heel and outwardly directed lip means secured to said body, said lip means being secured to said flange means.

18. The shoe of claim 13 including: rib means adjoined to the lip means and body to reinforce the upright position of the body.

19. The shoe of claim 13 including: a downwardly directed rib extended around the outer peripheral edge of the toe section of the sole.

20. The shoe of claim 13 including: a downwardly open groove located adjacent the inside of said rib separating the rib from the pad means on the toe section of the sole.

21. A sole for a shoe to accomodate a human foot comprising:

shoe sole means having the general shape of a bottom of a human foot including a heel, a toe section and an arch section located between the heel and toe section, said heel section having outwardly directed inside and outside flange means adjacent opposite sides thereof, a plurality of generally first longitudinal pads projected downwardly from said inside and outside flange means, a plurality of downwardly directed longitudinally spaced first transverse pad means located between said first longitudinal pads, said toe section having a second longitudinal pad extended along the center line of the sole and projected in a downward direction, a plurality of downwardly directed longitudinally spaced second transverse pad means located adjacent opposite sids of said second longitudinal pad, downwardly directed third transverse pad means located forwardly of the second longitudinal pad and second pad means, and downwardly directed fourth transverse pad means located between the second longitudinal pad and the first pad means.

22. The sole of claim 21 wherein: said first longitudinal pads include a pair of pads on each of said inside and outside flange means.

23. The sole of claim 22 wherein: said first transverse pads means each have a generally rectangular shape.

24. The sole of claim 21 including: a semi-circular shaped transverse pad located between the first longitudinal pads.

25. The sole of claim 21 wherein: the second longitudinal pad has a generally rectangular shape.

26. The sole of claim 25 wherein: the second transverse pad means each have a generally rectangular shape.

27. The sole of claim 21 wherein: the third transverse pad means includes a transverse generally rectangular pad and a semi-circular shaped pad located forwardly of the rectangular pad.

28. The sole of claim 21 wherein: the fourth transverse pad means each have a generally rectangular shape.

29. The sole of claim 21 including: a downwardly directed pad joined to the arch section of the sole means.

* * * * *